US009121619B2

(12) United States Patent
Potter

(10) Patent No.: US 9,121,619 B2
(45) Date of Patent: Sep. 1, 2015

(54) HYPER-AERATION APPARATUS FOR ATTIC VENTILATION

(75) Inventor: Paul S. Potter, Plano, TX (US)

(73) Assignee: Paul Stuart & Associates, LLC., Plano, TX (US)

( * ) Notice: Subject to any disclaimer, the term of this patent is extended or adjusted under 35 U.S.C. 154(b) by 933 days.

(21) Appl. No.: 13/136,856

(22) Filed: Aug. 12, 2011

(65) Prior Publication Data

US 2013/0040553 A1 Feb. 14, 2013

(51) Int. Cl.
*F24F 7/007* (2006.01)
*F24F 7/02* (2006.01)

(52) U.S. Cl.
CPC ..... *F24F 7/025* (2013.01)

(58) Field of Classification Search
CPC ..... F24F 7/02; F24F 7/025; F24F 7/04; F24F 7/06
USPC ..... 454/9, 15, 16, 24, 260, 338, 339, 341, 454/347, 358, 364, 365, 366, 367
See application file for complete search history.

(56) References Cited

U.S. PATENT DOCUMENTS

| | | | | | |
|---|---|---|---|---|---|
| 2,551,004 | A | * | 5/1951 | Johnson | 454/341 |
| 4,201,121 | A | * | 5/1980 | Brandenburg, Jr. | 454/250 |
| 4,776,385 | A | | 10/1988 | Dean | |
| 5,728,000 | A | | 3/1998 | Bateman | |
| 5,816,909 | A | * | 10/1998 | Wunder | 454/341 |
| 5,890,959 | A | * | 4/1999 | Pettit et al. | 454/184 |
| 6,079,166 | A | | 6/2000 | Mason | |
| 6,159,093 | A | * | 12/2000 | Mihalko, III | 454/341 |
| 7,677,964 | B1 | * | 3/2010 | Bucher et al. | 454/356 |
| 2005/0191957 | A1 | * | 9/2005 | Demetry et al. | 454/341 |
| 2006/0105699 | A1 | | 5/2006 | Kortuem | |
| 2009/0311958 | A1 | | 12/2009 | Grubka | |
| 2010/0227540 | A1 | | 9/2010 | Smith | |

OTHER PUBLICATIONS

Southface Energy Institute, "Ceiling and Attic Insulation and Ventilation", Dec. 11, 1998, Atlanta, GA.

* cited by examiner

*Primary Examiner* — Gregory Huson
*Assistant Examiner* — Dana Tighe
(74) *Attorney, Agent, or Firm* — Scott T. Griggs; Griggs Bergen LLP

(57) ABSTRACT

An aeration/ventilation device to be mounted on an aperture of a soffit may include a mounting platform to cooperate with the aperture of the soffit, a motor housing connected to the mounting platform, and a fan motor connected to the motor housing to a.) pull/draw cooler air in from the exterior of the soffit (under-eave) area of the building structure thus forcing the cooler air into the soffit interior and on into the attic space. b.) pull/draw hotter air out from the attic space into the interior of the soffit area thus forcing the hotter air out from the under-eave area of the structure. The aeration/ventilation device my use a double, single or multiple fan motors. These fan motors may be fixed to or be adjustable to the pitch angle of the roof structures. The aeration device my also include an electronic control housing to control the operation of the fan motors. The exhaust side of the motors may be fitted with adjustable air thruster device to create the effective exhaust velocity for improved air ventilation and circulation, along with a domed intake screens designed for improved air intake velocity. As well as being equipped with an intake rain guard(s).

6 Claims, 16 Drawing Sheets

HYPER-AERATION APPARATUS FOR ATTIC VENTILATION

CROSS-REFERENCE TO RELATED APPLICATIONS

N/A.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates generally to the art and science of ventilating building structures, and in particular to an apparatus that provides an attic aeration/ventilation method by powering, forcing, pushing or drawing cooler air into the attic space from the soffit or under-eave area location/region of a building structure.

2. Description of the Related Art

Because of climate changes related to global warming and the continued rapid demand and rising cost of energy, along with the incentives to preserve our energy resources, conservation is paramount for both domestic and the industrial/commercial end user.

For most end users located around and in between the earth's circle of latitude parallel planes 40 degrees north and 40 degrees south, air conditioning accounts for a substantial portion of the annual energy expense, Although most building structures are insulated, a substantial amount of energy is expended by the air conditioning compressor to pump the radiant absorbed by the building structure out of the air conditioned living space into the outside ambience.

As an air conditioning systems compressor load is being intensified by the heat gain forces/thermal storage effects associated within the attic air space found in building structures, temperature can continue to rise rapidly as solar radiation is absorbed.

The results are a large amount of heat is transferred from the exposed roof structure to the air trapped within the attic air space. This body of trapped air in the attic space acts as a thermal reservoir which transfers heat through the ceiling and into the air conditioned living space.

Because of the large thermal mass associated within the attic air space and the roof structure, heat can start transferring through the ceiling and into the air conditioned space beginning in the early morning hours and not substantially subside until late night.

The thermal mass storage effect of trapped or stagnant attic air in the past has been address by the actions found in two different types of attic vents which are classified as Intake and Exhaust Attic Vents.

Intake vents allow fresh air from outside the structure to enter the attic, and the Exhaust vents allow the air to escape.

Intake vents are static vents that are typically found in the soffit or the under eave area of a structure and are used for air intake. These static type vents typically consist of soffit vents, under eave vents along with other variations of continuous perforated venting materials.

This type static ventilation technology meets the minimum in building ventilation requirements and is also minimally efficient in regards to intake air performance.

Exhaust vents are the attic vents that allow air to escape. Exhaust vents may be static or powered.

Static exhaust vents allow the air to escape with no powered assistance, while exhaust powered ventilators use power to move the air out of the attic space.

These types of exhaust vents are located on or near the peak of the roof.

Static Exhaust Vents that are used on or near the peak or the roof typically consist of Ridge Vents, Roof Louvers, Wall Louvers and Wind Turbines.

Powered Exhaust Ventilators that are used on or near the peak of the roof typically consist of Powered Attic Ventilators and Powered Side Wall Ventilators types.

The Powered Vents are typically mounted on or near the peak roof area of the building structure and use an "Exhaust Method" for vacating hot air by a "drawing air up effect" along with using the typically static intake vents located in the soffits as described above.

This method of ventilation is also not as efficient as it should be because the air that is being generated up through the static vents below for ventilation is being heated up by the thermal environment and radiation effect of that found in the attic at a comparable rate.

Because the air is being "drawn up" from a large distributed area, in an uncondensed volume and rate the air has the propensity to heat up rapidly.

Also the air flow is typically drawn toward the underside of the roof through the joist and does not necessarily directly affect any of the thermal loading trapped in the insulation at the ceiling level of the structure.

Although the past prior art of Power Attic Ventilation methods have held out the promise of reducing energy consumption in building structures, through research funding by the U.S. Department of Energy and the U.S. Environmental Protection Agency have found and have expressed concerns that these devices do not necessarily realizing their perceived benefits and that they are:

Costly to operate/Uses more electricity than their benefits

Pull or suck air conditioned air from your living area into the attic space

Removes air from the home through ceiling leaks and associated bypasses

Increasing electricity cost and operation of the air conditioning compressor

Threat of back drafting combustion gases into a house living area

Pull pollutants from the crawlspace such as mold, radon, and sewer gases into the home Back drafting fireplaces, water heaters as well as other fuel burning appliances

OBJECT OF THE INVENTION

It is therefore the principle object of the present invention to provide an improved process, method and strategy to improve attic ventilation performance.

The related objects of this invention is to address and elevate the conditions or issues that the past prior art could have contributed to or did not address.

Another object of the invention is to equalize, reduce, prevent or eliminate the negative pressures or vacuum effect caused by possible conditions of the prior art found in traditional power attic ventilators.

An additional object of the invention is to provide an aeration/ventilation method and approach by drastically improving and increasing the amount of cooler air intake, thus increasing intake/net air volume significantly.

And another object of the invention is to provide an authentic offensive (Powered Soffit/Under Eave Intake) ventilation strategy in contrast to a defensive (Powered Roof Exhaust) strategy.

Yet another object of the invention in addition and in concert is to enhance the performance with the other existing ventilation methods.

BRIEF SUMMARY OF THE INVENTION

The First Aspects of the Invention

The aeration/ventilation device of the present invention provides a powered and/or pressured apparatus that uses the cooler air from the soffit or the under eave area of the building structure to cool the attic. The present invention provides an authentic offensive ventilation strategy in contrast to a defensive strategy. The present invention adds cooler air in to the attic space vs. taking away hot air and heating up cooler air from broad intake.

The Second Aspects of the Invention

The aeration device may be mounted on the soffit/under the eave of the building structure or may be mounted in the attic roof joist area while ducting cooler air in from the soffit/under the eave area of the building structure. The aeration device provides a soffit/under eave powered intake or outtake vent or an in attic mount powered intake or outtake vent. The aeration apparatus can either bring air in or push air out/or both using a powered intake or exhaust method of cooling the attic.

The Third Aspects of the Invention

The present invention provides an accelerated approach to cooling the attic space by increasing the air volume delivered, net air volume, and fresh air turnover rates, thus improving and reducing the time to provide cooler air into the attic space. The present invention reduces heat gain forces, thermo storage, thermal heat mass, heat load and the thermo shock effect from solar radiation by delivering cooler air directly at the ceiling level not just at the underside of an attics roof interior.

The Fourth Aspects of the Invention

The present invention can equalize, reduce, prevent or eliminate the negative pressure or vacuum effects caused by the prior art found in traditional power attic ventilators. The present invention by normalizing these pressures can reduce the actions of the removal of conditioned air from the building structure through ceiling leaks and bypasses. The present invention can reduce or prevent the pulling pollutants from the crawlspace such as mold, radon, and sewer gasses into the building structure. The present invention can decrease the chances of the back drafting of fireplaces, water heaters and other fuel-burning appliances.

The Fifth Aspects of the Invention

The invention eliminates the rate on putting the concern for the entrainment of intake moisture during operation. The invention eliminates the use of roof mounted intake ventilators, mounted just before the overhang, located directly in a heat effective zone which can bring hot air into the attic space generated by the radiation absorbed by the roof shingles. The invention eliminates the ventilation challenges found in building structures that have a limited amount or insufficient soffit/under eave area in order to provide adequate air flow in the attic space.

The Six Aspects of the Invention

The present invention offers a new technologically approach to ventilation and cooling an attic space over the previous/prior methods that have been using static intake and static/powered exhaust ventilators. The present invention may also be used in concert with a variety of other static ventilation technologies. The present invention may be used in concert to improve the efficiency and performance of other types of legacy powered attic or wall mounted ventilators. The present invention can be used with new building material technologies to further enhance the reduction of attic temperatures while providing additional energy savings and also to extend the life of those materials.

The Seventh Aspects of the Invention

The present invention provides an innovative method of removing excess heat and moisture to protect the roof from premature deterioration; Safeguarding attic possessions against mildew damage; Limiting the growth of harmful mold; Providing the roof protection from premature deterioration and roof rot; Minimizing peeling to extend the life of exterior and interior paint; Guards against ice damming in harsh winter climates and; Viably reducing excessive heat and air conditioning energy expense.

The Eight Aspects of the Invention

The present invention provides the architectural and structural benefits by replacing, reducing or eliminating the unsightly appearances on the roof structure from the use of other powered attic roof ventilators.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION OF THE INVENTION

Figure 1:
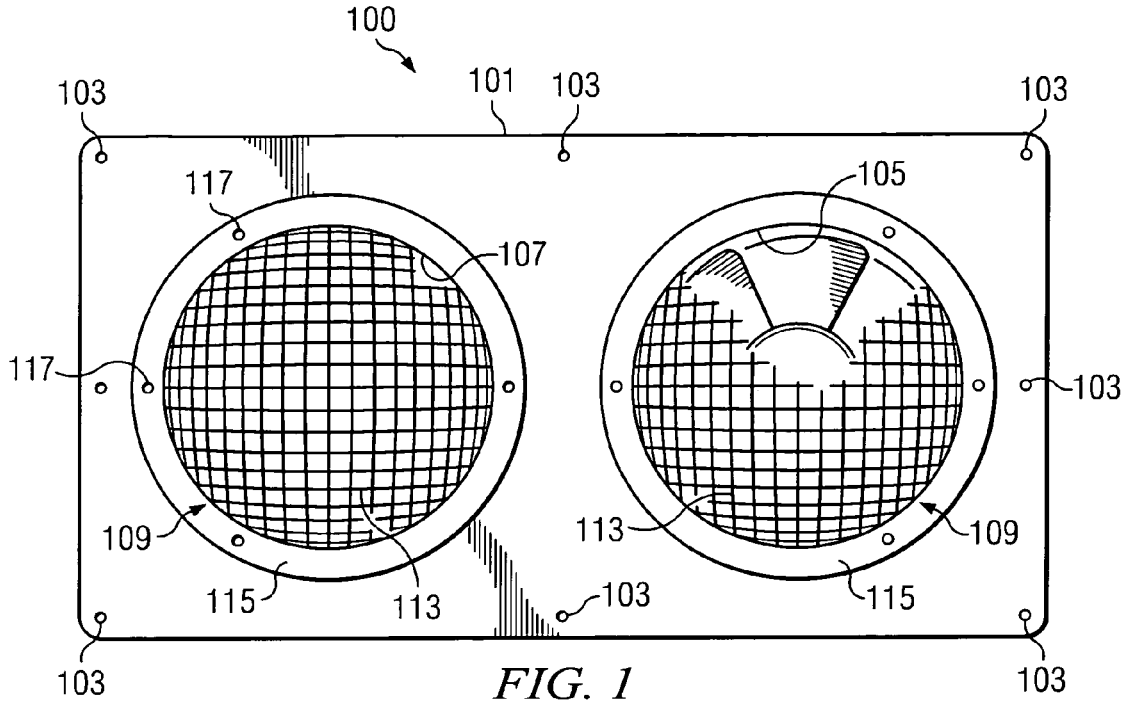
FIG. 1 illustrates a bottom view of the aeration apparatus (100) of the present invention.

While the invention is susceptible to various modifications and alternate forms, specific embodiments thereof have been shown by way of example in the drawings and herein described in detail. It should be understood, however that the description herein of specific embodiments is not intended to limit the invention to the particular forms disclosed. It is also to be understood that there is no invention to limit the invention to the specially disclosed embodiments but that the invention may be practiced using other features, elements methods and embodiments.

FIG. 1 illustrates a bottom view of the aeration apparatus (100) (or novel soffit vent) of the present invention, and the aeration apparatus (100) may include a mounting platform/plate 101 which may be formed from a solid aluminum, stainless or metal plate, wood, plastic or other suitable material. The mounting plate 101 may be rigid and formed in a rectangle, square, oval, circle or other shape device and may be shaped and sized to substantially cover a soffit opening and may include mounting apertures 103 which may extend around the periphery of the mounting plate 101 in order to cooperate with fasteners (not shown) such as screws, bolts or nails to mount over the soffit.

The mounting plate 101 may include only a first aperture 105 or may include a first aperture 105 and may include a second aperture 107 or multiples. The first aperture 105 and the second aperture 107 may be substantially mirror apertures and may extend through the mounting plate 101.

FIG. 1 additionally illustrates an exterior filter 109 which may include a grid of intersecting wires and which may cover the first aperture 105 and may cover the second aperture 107 in order to prevent foreign objects from entering the first aperture 105 and the second aperture 107. The exterior filter 109 may be mounted to the mounting plate 101 by a mounting ring 115 which may include apertures 117 to cooperate with fasteners (not shown) to fasten to the mounting plate 101. The fasteners may be bolts, screws or other types of fasteners. Cooler air from the outside of a home or building is pulled into an attic by the fans. Warmer attic air then escapes the attic through an output vent thus cooling the attic space.

Figure 2:
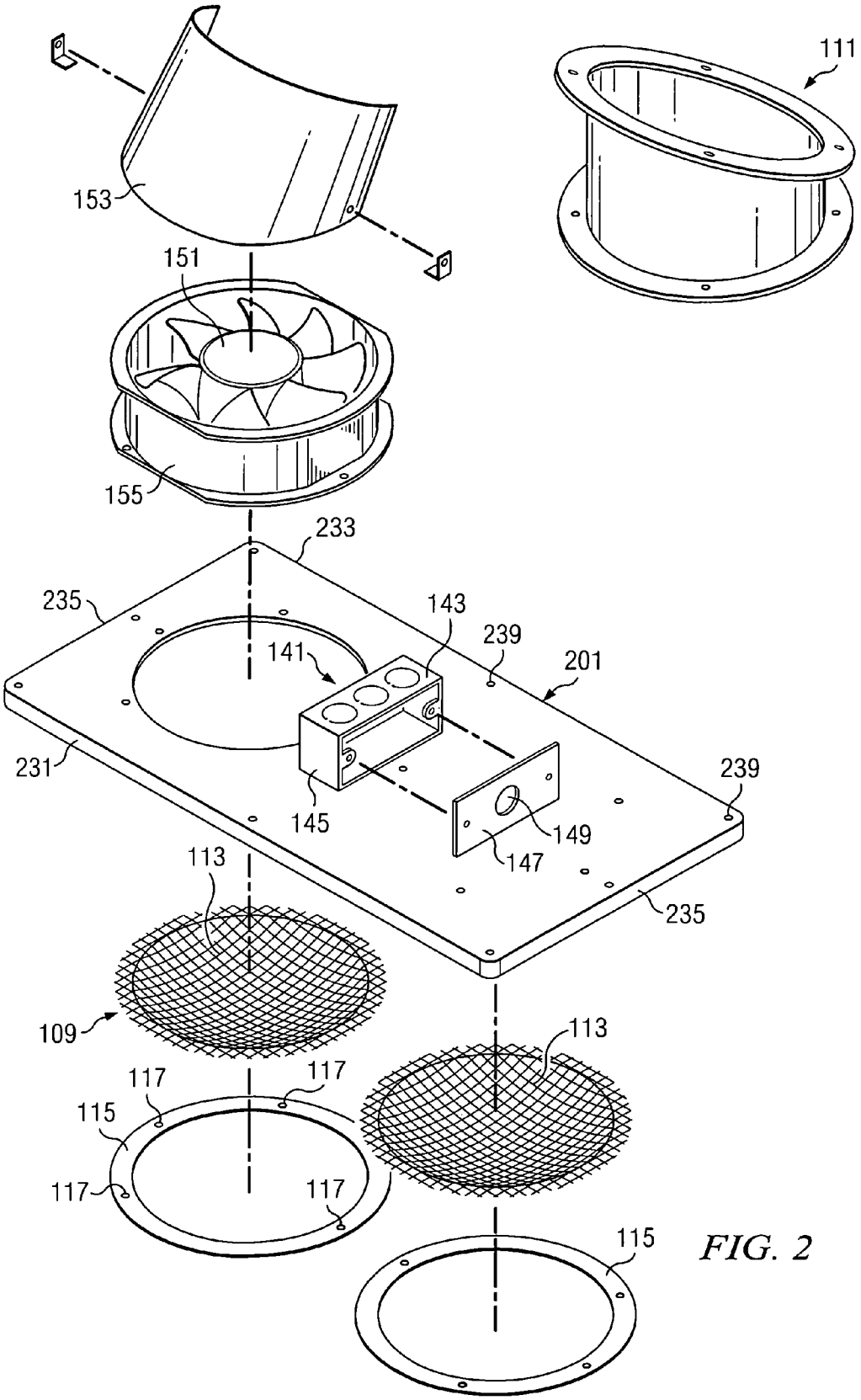
FIG. 2 illustrates an exploded view of the aeration apparatus (100) of the present invention.

FIG. 2 illustrates an exploded view of the aeration device (100) of the present invention and illustrates a mounting platform 201 (the mounting platform may be substituted for the mounting plate) which may include a front wall 231 which may be opposed to a back wall 233 and which may be connected to a pair of opposing side walls 235, the back wall 233 which may be connected to the opposing side walls 235, the side walls 235 and the top wall 237 which may be connected to the front wall 231, the side walls 235 and the back wall 233 around the periphery of the top wall 237. The mounting platform 201 may be formed from metal, plastic, wood or other appropriate material and may be rigid. FIG. 2 additionally illustrates mounting apertures 239 which may extend through the top wall 237 to cooperate with fasteners to connect the mounting platform 201 to the soffit.

FIG. 2 additionally illustrates the exterior filter 109, the intersecting wires 113 and the mounting ring 115 including the apertures 117.

FIG. 2 illustrates a control housing 141 which may be mounted on the top wall 237 of the mounting platform 201 and which may include a top wall 143 which may be connected to a pair of opposing side walls 145. The control housing 141 maybe formed from plastic, metal or other appropriate material and may be hollow in order to cover and protect electrical circuits and connections. The electrical housing 141 maybe formed from plastic, metal, wood or other appropriate material and may be rigid. The side walls 145 and the top wall 143 may be detachably connected to a detachably connected front wall 147 which may be removable and replaceable. The front wall 147 may include an aperture 149 to cooperate with wires (not shown) to power the fan motor 151 which may be connected to the mounting platform 201. A fluid deflector 153 which may deflect and redirect a fluid such as air may be connected to a motor housing 155 which may be a hollow cylinder to house the fan motor 151, and the fluid deflector may be a truncated dome and formed from metal, plastic, wood or other appropriate material. The fluid deflector 153 may be rigid or flexible.

Figure 3:
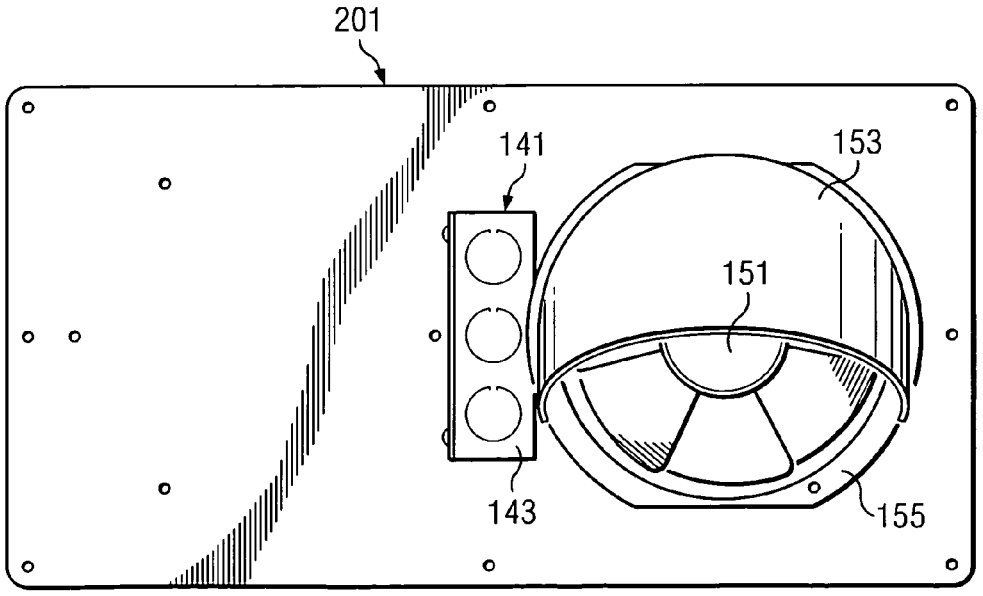
FIG. 3 illustrates a top view of a the aeration apparatus (100) of the present invention.

FIG. 3 illustrates a top view of the aeration apparatus (100) and illustrates a mounting platform 201, the top wall 143 of the control housing 141, the fan motor 151 the motor housing 155 and the fluid deflector 153.

Figure 4:
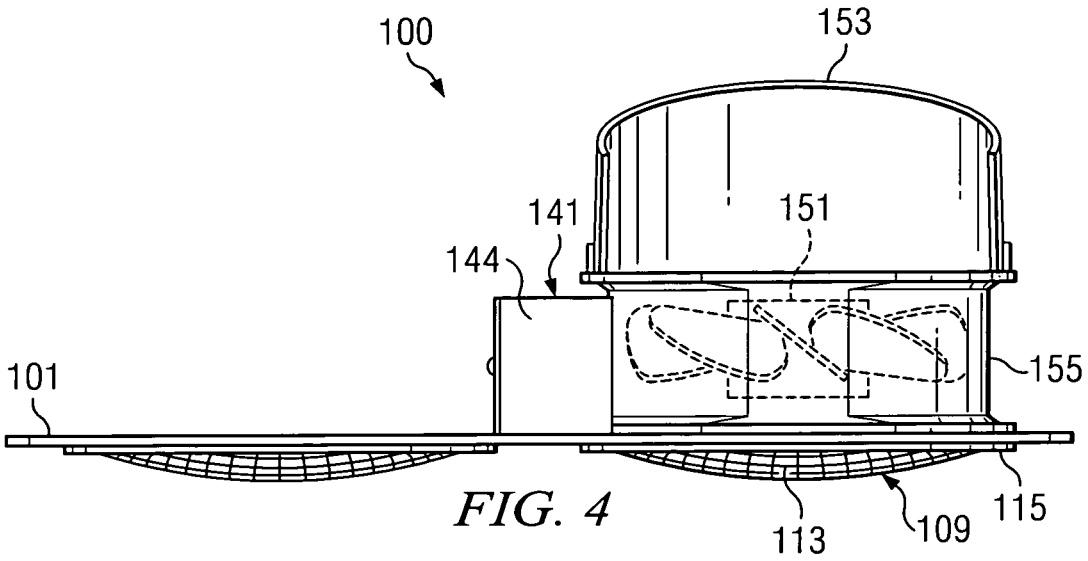
FIG. 4 illustrates a side view of the aeration apparatus (100) of the present invention.

FIG. 4 illustrates a side view of the aeration apparatus (100) and illustrates the mounting plate 101, the sidewall 145 of the control housing 141, the exterior filter 109, the wires 113, the fan motor 151 and the motor housing 155.

Figure 5:
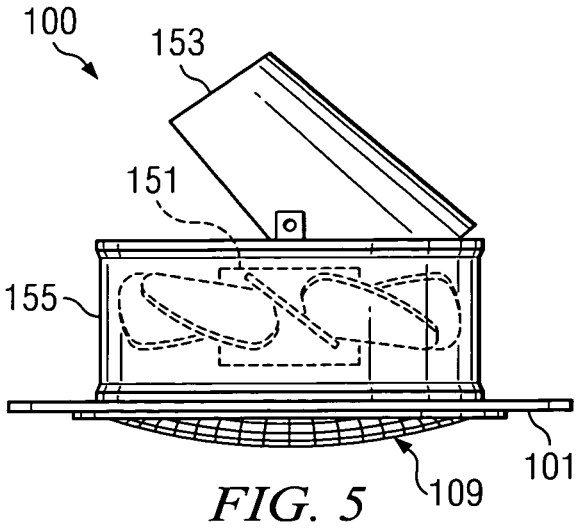
FIG. 5 illustrates a side view of the aeration apparatus (100) of the present invention.

FIG. 5 illustrates a side view of a section of the aeration apparatus (100) and illustrates the mounting plate 101, the exterior filter 109, the wires 113, the fan motor 151, the fluid deflector device 153 and the motor housing 155.

Figure 6:
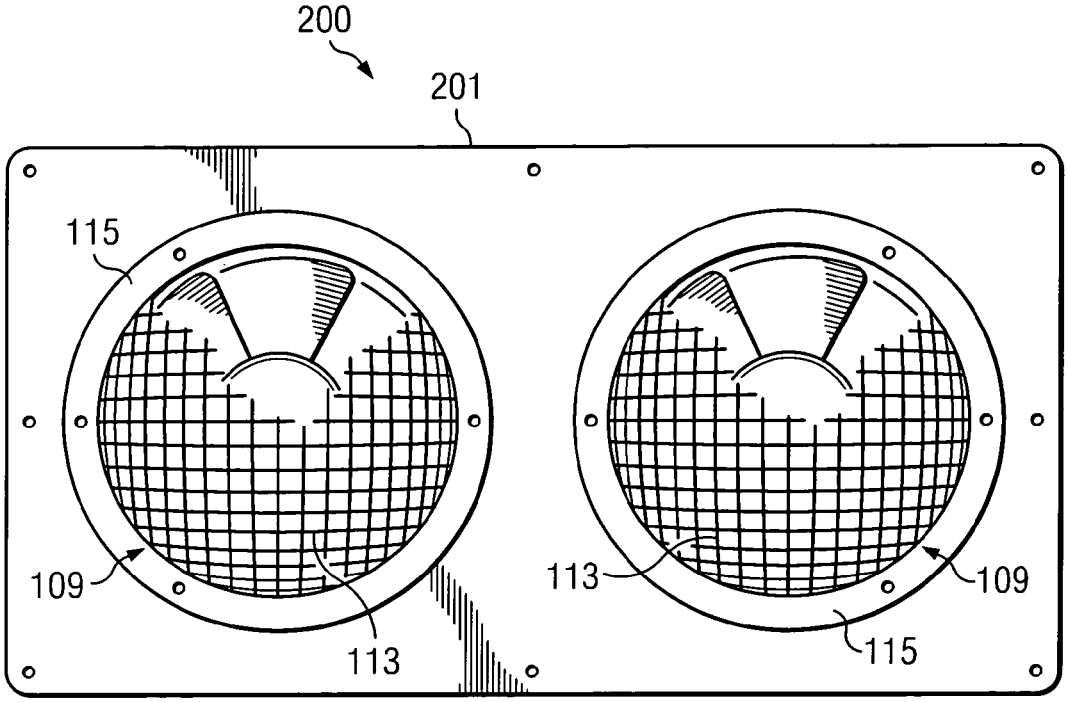
FIG. 6 illustrates a bottom view of the aeration apparatus (200) of the present invention.

FIG. 6 illustrates a bottom view of the aeration apparatus (200) which may include a first and second exterior filter 109 which may include wires 113 and a first and second mounting ring 115.

Figure 7:
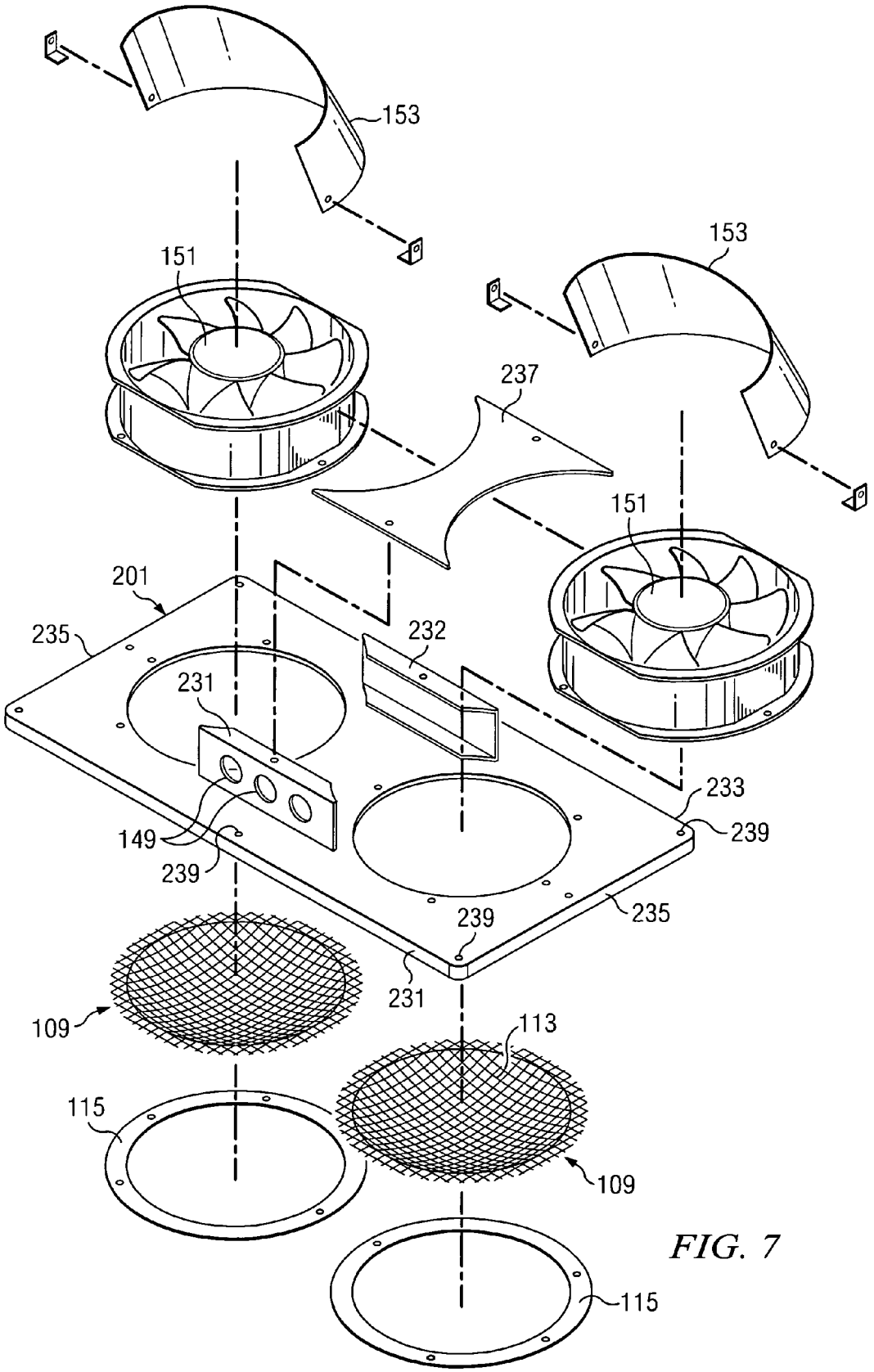
FIG. 7 illustrates an exploded view of the aeration apparatus (200) of the present invention.

FIG. 7 illustrates an exploded view of an aeration apparatus (200) of the present invention having a first and second fan. the present invention and illustrates a mounting platform 201 (the mounting platform may be substituted for the mounting plate) which may include a front wall 231 which may be opposed to a back wall 233 and which may be connected to a pair of opposing side walls 235, the back wall 233 which may be connected to the opposing side walls 235, the side walls 235 and the top wall 237 which may be connected to the front wall 231, the side walls 235 and the back wall 233 around the periphery of the top wall 237. The mounting platform 201 may be formed from metal, plastic, wood or other appropriate material and may be rigid. FIG. 7 additionally illustrates mounting apertures 239 which may extend through the top wall 237 to cooperate with fasteners to connect the mounting platform 201 to the soffit.

FIG. 7 additionally illustrates the exterior filter 109, the intersecting wires 113 and the mounting ring 115 including the apertures 117.

FIG. 7 illustrates a control housing 141 which may be mounted on the top wall 237 of the mounting platform 201 The control housing 141 may be formed from plastic, metal, wood or other appropriate material and may be rigid. The front and back walls 231, 233 and the top wall 237 may be detachably connected to a detachably connected to front and back walls 231, 233 which may be removable and replaceable. The front wall 231 may include a first and second and third apertures 149 to cooperate with wires (not shown) to power the first and second fan motors 151 which may be connected to the mounting platform 201. First and second fluid defectors 153 which may deflect and redirect a fluid such as air may be connected to first and second motor housings 155 which may be a hollow cylinder to house the fan motor 151, and the first and second fluid defectors 153 may be a truncated dome and formed from metal, plastic, wood or other appropriate material. The first and second fluid deflectors 153 may be rigid or flexible.

FIG. 7 additionally illustrates mounting apertures 239 which may extend through the top wall 237 to cooperate with fasteners to connect the mounting platform 201 to the soffit.

FIG. 7 additionally illustrates the first and second exterior filters 109, the intersecting wires 113 and first and second mounting rings 115 including the apertures 117.

Figure 8:
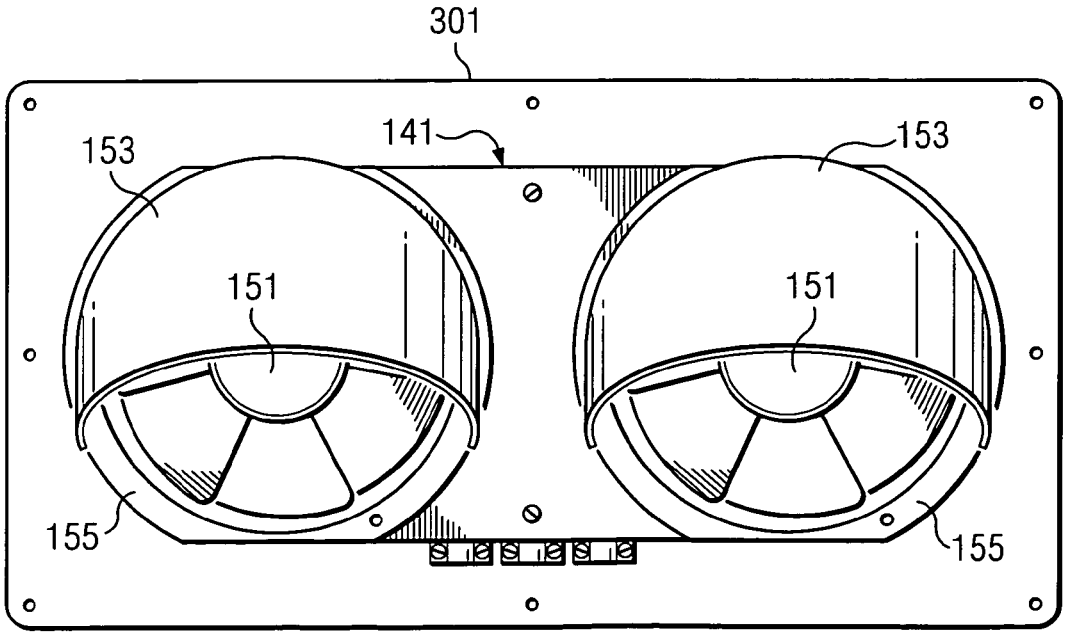
FIG. 8 illustrates a top view of the aeration apparatus (200) of the present invention.

FIG. 8 illustrates a top view of an aeration apparatus (200) which may include a mounting platform 201, the top wall 237 of the control housing 141 the first and second fan motor 151, and the first and second motor housing 155.

Figure 9:
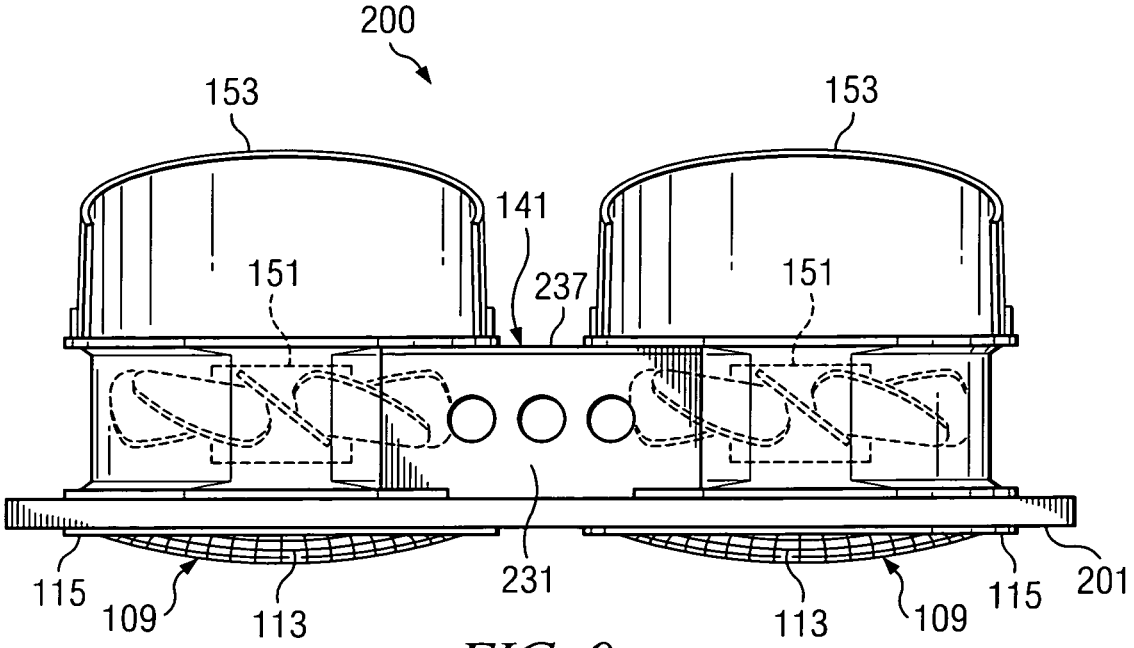
FIG. 9 illustrates a side view of the aeration apparatus (200) of the present invention.

FIG. 9 illustrates a side view of the aeration apparatus (200) and illustrates the mounting plate 201, the control housing 141, the exterior filter 109, the fan motor 151 and the motor housing 155. FIG. 9 additionally illustrates the fluid defection device 153.

Figure 10:
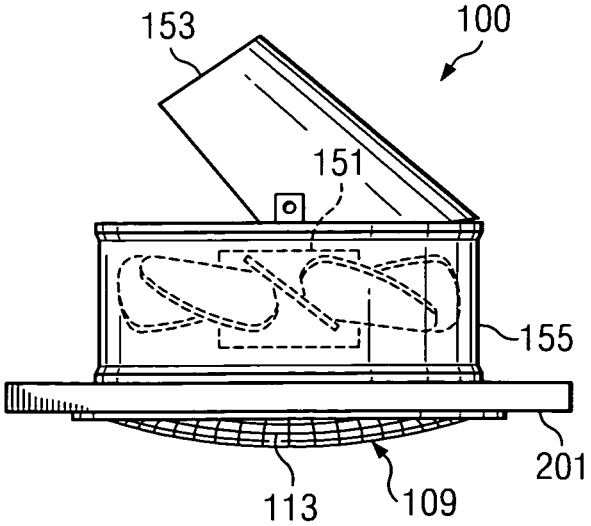
FIG. 10 illustrates a side view of the aeration apparatus (200) of the present invention.

FIG. 10 illustrates a side view of a section of the aeration apparatus (200) and illustrates the mounting plate 101, the exterior filter 109, the wires 113, the fan motor 151, the fluid deflector device 153 and the motor housing 155.

Figure 11:
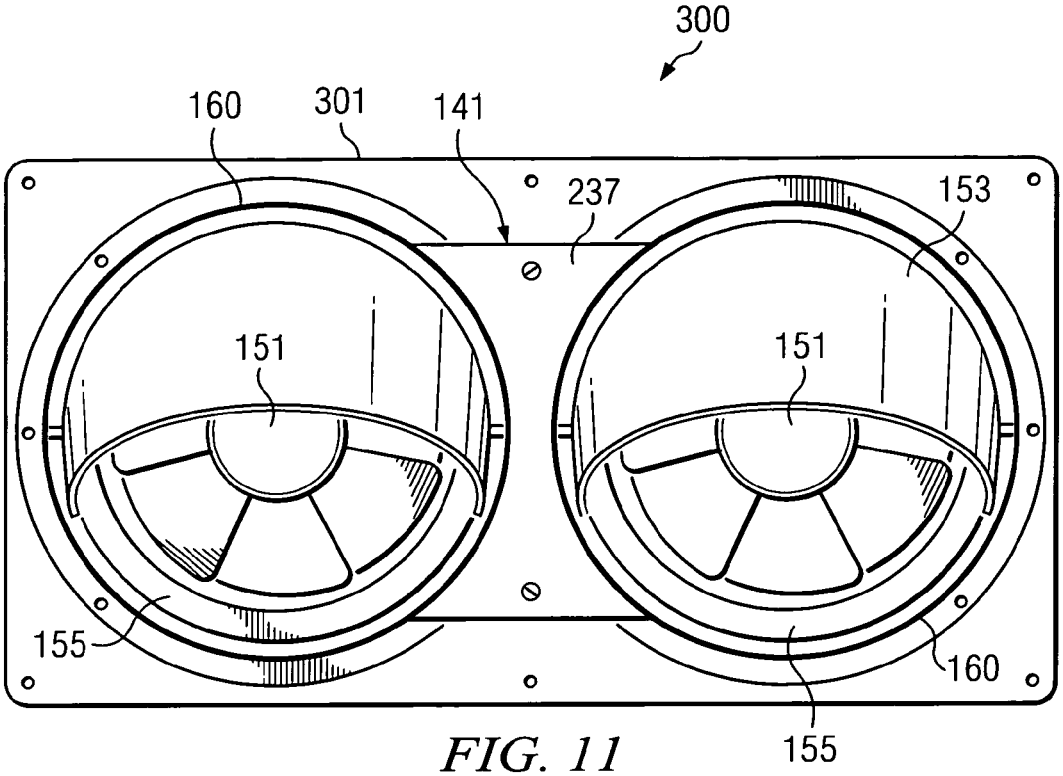
FIG. 11 illustrates a top view of the aeration apparatus (300) of the present invention.

FIG. 11 illustrates a top view of the aeration apparatus (300) which may include a mounting platform 301, the top wall 237 of the control housing 141, the first and second fan motor 151, and the first and second motor housing 155.

Figure 12:
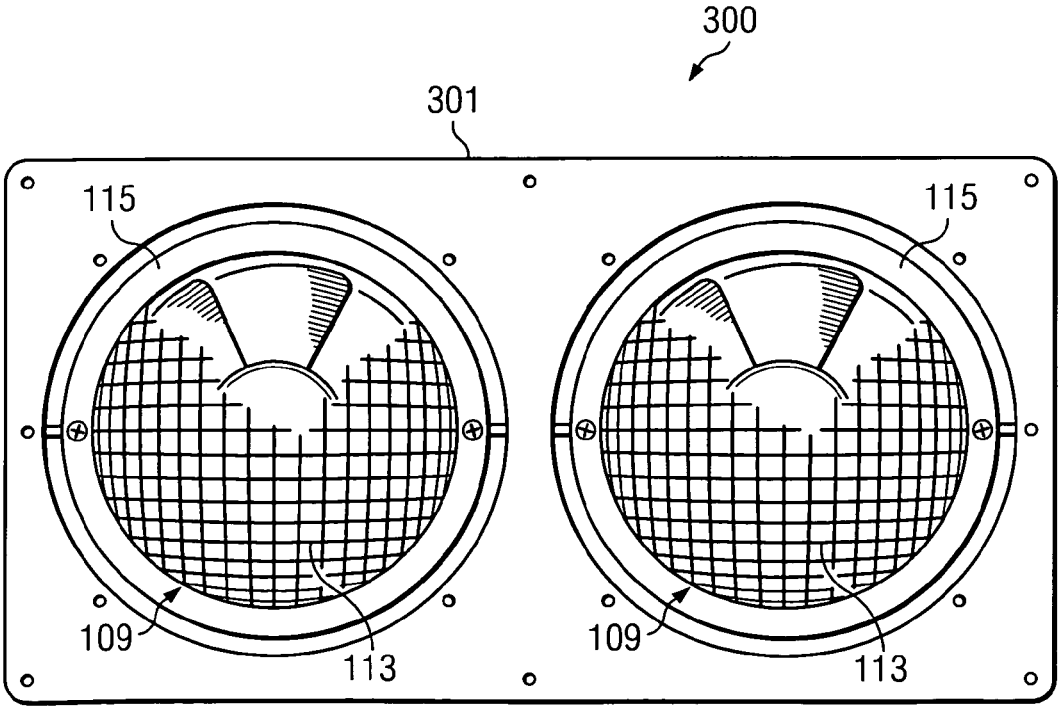
FIG. 12 illustrates a bottom view of the aeration apparatus (300) of the present invention.

FIG. 12 illustrates a bottom view of the aeration apparatus (300) which may include a first and second exterior filter 109 which may include wires 113 and a first and second mounting ring 115.

Figure 13:
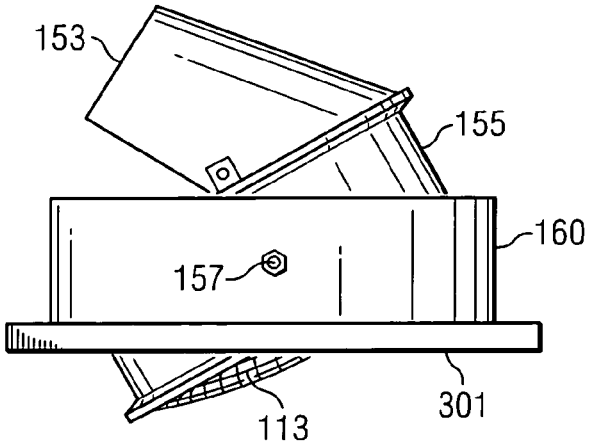
FIG. 13 illustrates a side view of the aeration apparatus (300) of the present invention.
Figure 15:
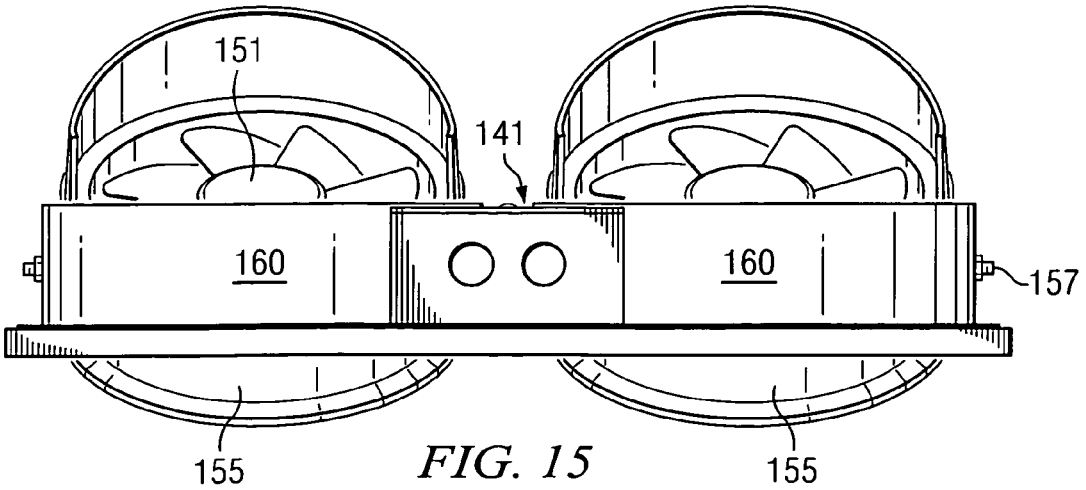
FIG. 15 illustrates a front view of the aeration apparatus (300) of the present invention.

FIG. 13 illustrates a side view of the aeration apparatus (300) in which the fan motor 151 and the motor housing 155 have been pivoted and rotated on the shafts 157 supported by the circular formed flange 160 with respect to the mounting platform 301. FIG. 15 additionally illustrates the fluid defection device 153.

Figure 14:
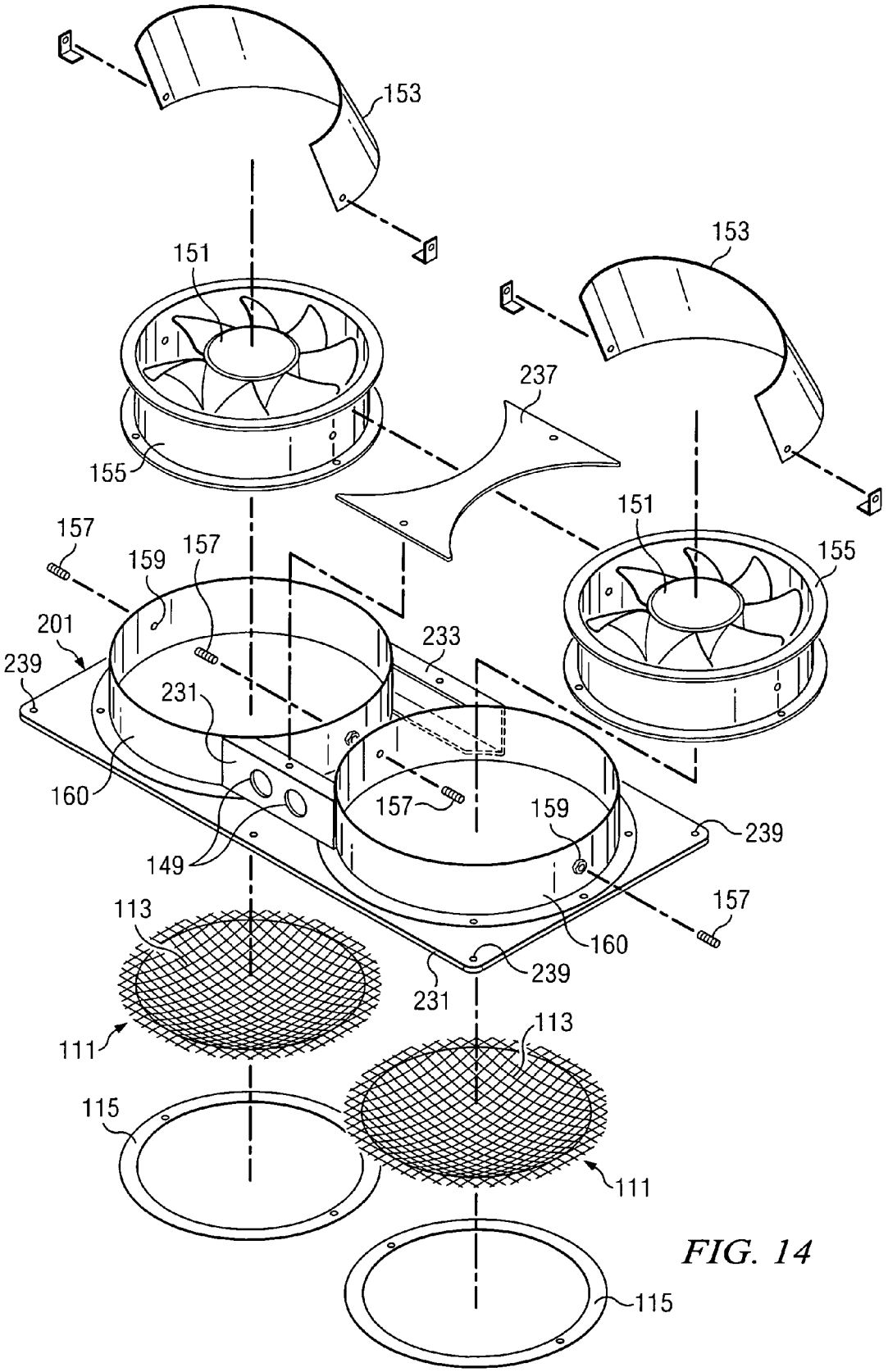
FIG. 14 illustrates an exploded view of the aeration apparatus (300) of the present invention.

FIG. 14 illustrates an exploded view of the aeration device (300) having a first and second fan which may be pivotal with respect to the mounting platform 201 of the present invention and illustrates a mounting platform 201 (the mounting platform may be substituted for the mounting plate) which may include a front wall 231 which may be opposed to a back wall 233, the back wall 233 which may be connected to the top wall 237 which may be connected to the front wall 231 and the back wall 233 around the periphery of the top wall 237. The mounting platform 201 may be formed from metal, plastic, wood or other appropriate material and may be rigid.

FIG. 14 illustrates a control housing 141 which may be mounted on the top wall 237 of the mounting platform 201. The control housing 141 may be formed from plastic, metal, wood or other appropriate material and may be rigid. The front and back walls 231, 233 and the top wall 237 may be detachably connected to a detachably connected to front and back walls 231, 233 which may be removable and replaceable. The front wall 231 may include a first and second apertures 149 to cooperate with wires (not shown) to power the first and second fan motors 151 which may be connected to the mounting platform 201. First and second fluid defectors 153 which may deflect and redirect a fluid such as air may be connected to first and second motor housings 155 which may be a hollow cylinder to house the fan motor 151, and the first and second fluid defectors 153 may be a truncated dome and formed from metal, plastic, wood or other appropriate material. The first and second fluid deflectors 153 may be rigid or flexible.

FIG. 14 additionally illustrates mounting apertures 239 which may extend through the top wall 237 to cooperate with fasteners to connect the mounting platform 201 to the soffit.

FIG. 14 additionally illustrates the first and second exterior filters 109, the intersecting wires 113 and first and second mounting rings 115 including the apertures 117.

Further, FIG. 14 illustrates the first and second interior filters 111 which may include overlapping wires 113.

FIG. 14 additionally illustrates a first and second aperture 159 extending through the first and second motor housings 155 respectively. The first and second aperture 159 cooperates with a first and second shaft 157 which may cooperate with the first and second motor housings 155 by being pivotal with respect to the first and second shaft 157 so that the motor housing 115 can be tilted at an acute angle with respect to the mounting platform 201.

FIG. 15 illustrates a front view of the aeration apparatus in which the fan motor 151 and the motor housing 155 have been pivoted and rotated on the shafts 157 supported by the circular formed flange 160 with respect to the mounting platform 201. FIG. 15 additionally illustrates the control housing 141.

Figure 16:
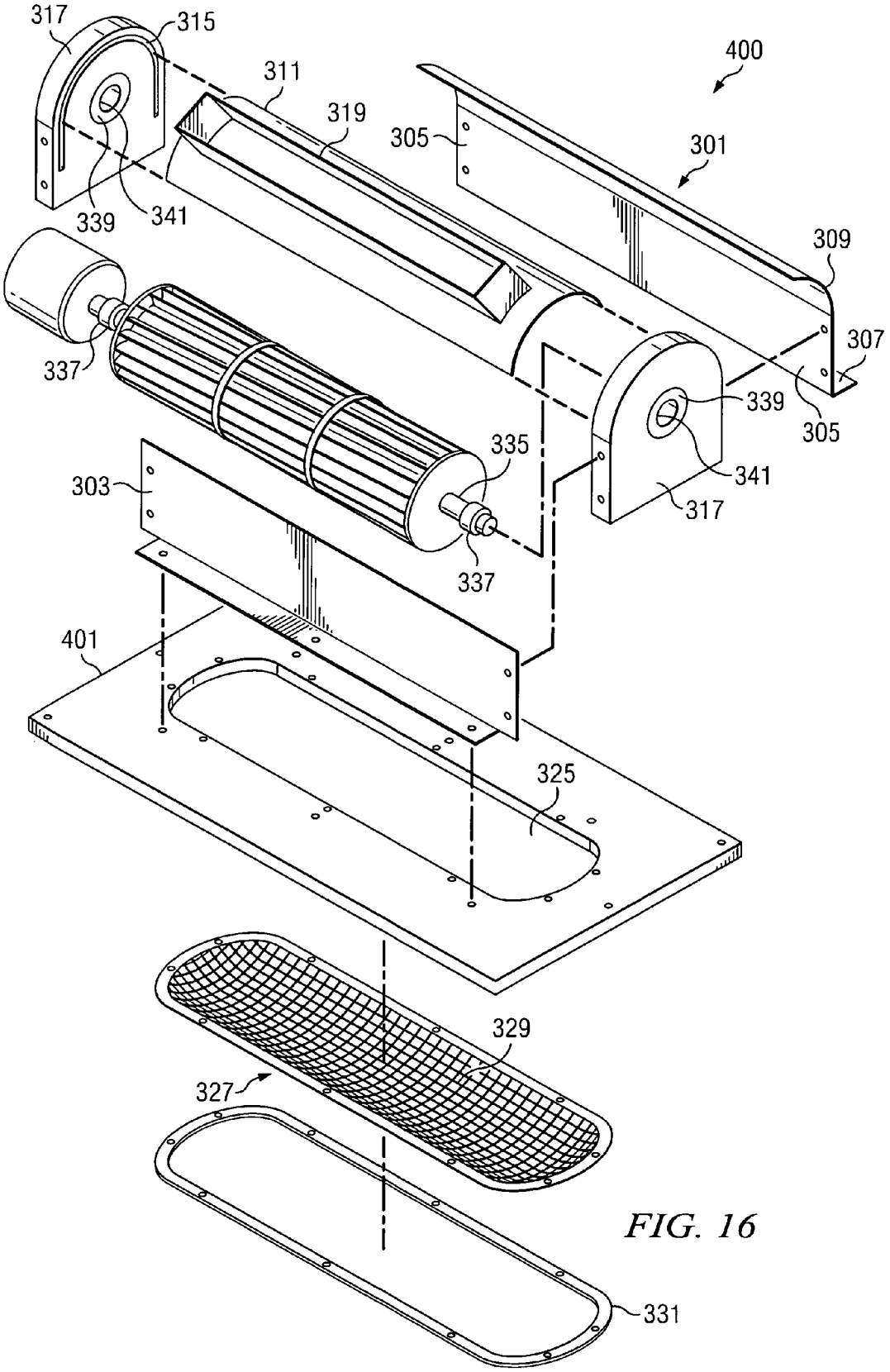
FIG. 16 illustrates an exploded view of an aeration apparatus (400) of the present invention.

FIG. 16 illustrates an exploded view of the aeration device (400) of the present invention, and the aeration device (400) illustrates a mounting platform 401 (the mounting platform may be substituted for the mounting plate) which may include a housing 401 which may be formed from a rigid material such as metal plastic or other such material and which may be hollow. The housing 401 which may include a front wall 303 which may be elongated and which may be L-shaped and may include a back wall 305 which may include a shoulder 307 and a curved portion 309. The housing 301 may include a top wall 311 which may pivotally rotate within a pair of opposing interior tracks 315 which may be formed on the interior wall of the sidewall 317 and which may extend discontinuously around the perimeter of the sidewall 317. The end of the top wall 311 may cooperate with the interior tracks 315 to pivot the top wall 311. The top wall 311 may be concavely curved in order to facilitate the movement within the interior tracks 315, and the top wall 311 may include an air guide device 319 which may extend outwards from the exterior surface of the top wall 311 to guide the fluid such as air from the elongated fan blades 321.

The housing 301 may be connected to the bottom plate 323 which may have a central aperture 325 to allow air to enter the elongated fan blades 321. In addition, and external filter 327 may be connected to the bottom plate 323. The external filter 327 may include intersecting wires 329. A mounting ring 331 may hold the external filter 327 on the bottom plate 323.

FIG. 16 additionally illustrates a motor 333 which may rotate the elongated fan blade 321 on a shaft 335 which may be connected to cylinders 337 which may cooperate with the bearing 339 having a central aperture 341 to rotate the elongated than blade 321 within the housing 301.

Figure 17:
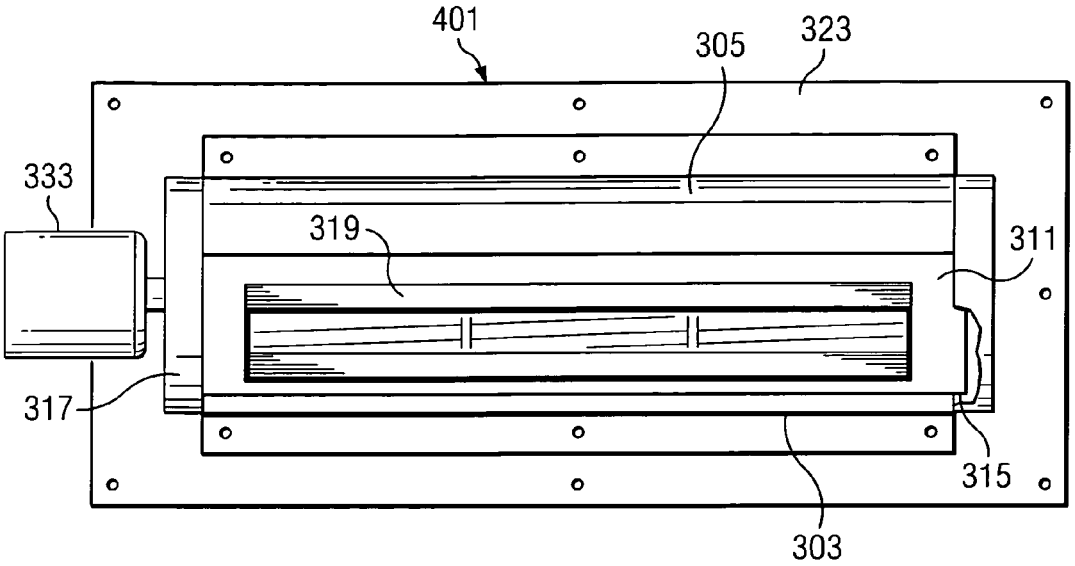
FIG. 17 illustrates a top view of the other aeration apparatus (400) of the present invention.

FIG. 17 illustrates a top view of the aeration device (400) and illustrates the motor 333, the guide device 319 which may extend from the top wall 311 which may pivot within the interior tracks 315 of the sidewall 317, the top wall 311, the side walls 317, the front wall 303, and the bottom plate 323.

Figure 18:
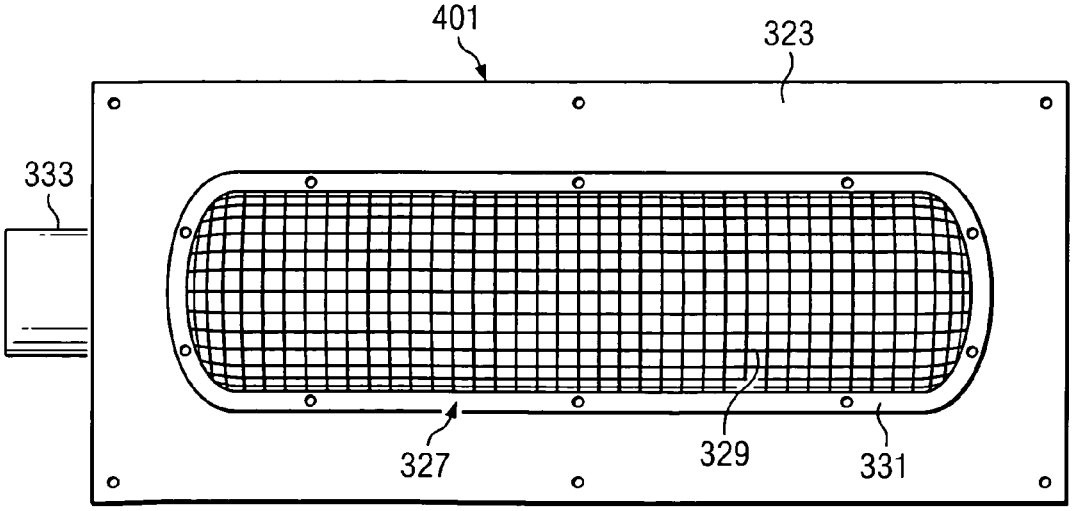
FIG. 18 illustrates a bottom view of the other aeration apparatus (400) of the present invention.

FIG. 18 illustrates the exterior filter 327 and the ring 329 which connect to the bottom plate 323.

Figure 19:
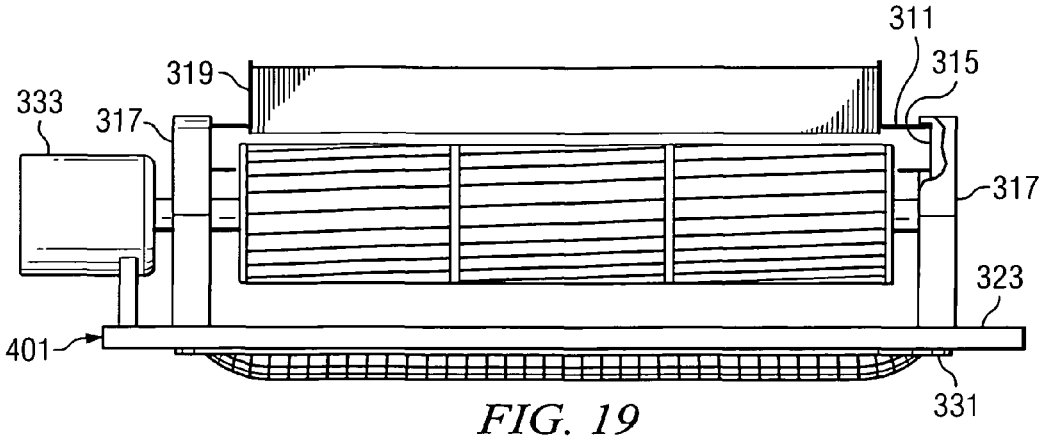
FIG. 19 illustrates a side view of the other aeration apparatus (400) of the present invention.

FIG. 19 illustrates a front cross-sectional view of the aeration device (400) and illustrates the motor 333, the guide device 319 which may extend from the top wall 311 which may pivot within the interior tracks 315 of the sidewall 317, the top wall 311, the side walls 317, and the bottom plate 323.

FIG. 19 illustrates the exterior filter 327 and the ring 329 which connect to the bottom plate 323.

Figure 20:
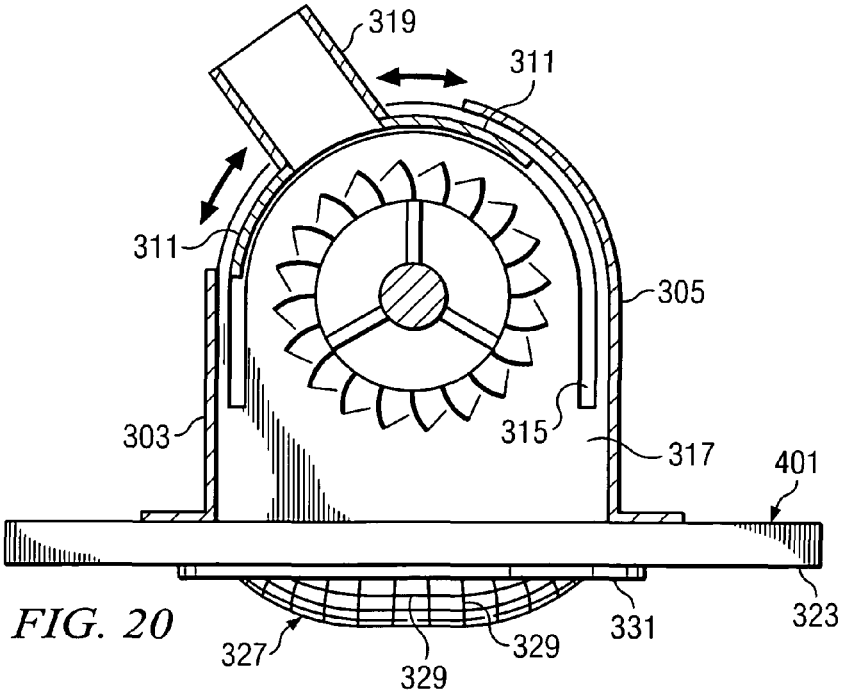
FIG. 20 illustrates a side view of the other aeration apparatus (400) of the present invention.

FIG. 20 illustrates a side cross-sectional view of the aeration device (400) and illustrates the guide device 319 which may extend from the top wall 311 which may pivot within the interior tracks 315 of the sidewall 317, the top wall 311, the side walls 317, the front wall 303, and the back wall 305 and the bottom plate 323.

FIG. 20 illustrates the exterior filter 327 and the ring 329 which connect to the bottom plate 323.

Figure 21:
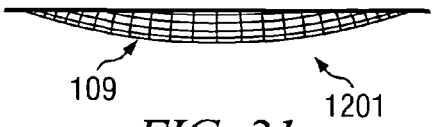
FIG. 21 illustrates a side view of the wire mesh guard diagram of the aeration apparatus of the present invention.

FIG. 21 illustrates a side view 1201 of the exterior filter 109, the intersecting wires 113 illustrating a domed wire mesh guard of the present invention.

Figure 22:
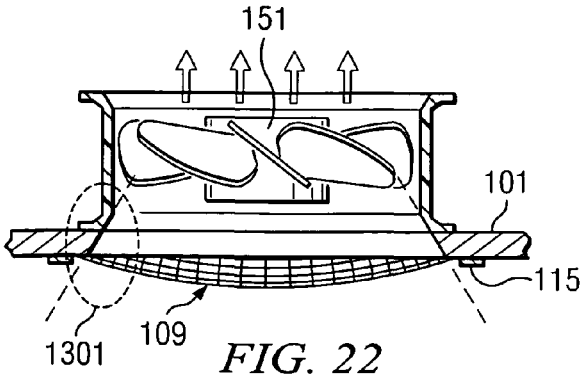
FIG. 22 illustrates a cross section view air intake diagram of the aeration apparatus of the present invention.

FIG. 22 illustrates a cross section view air intake diagram 1301 of the aeration apparatus of the present invention.

Figure 23:
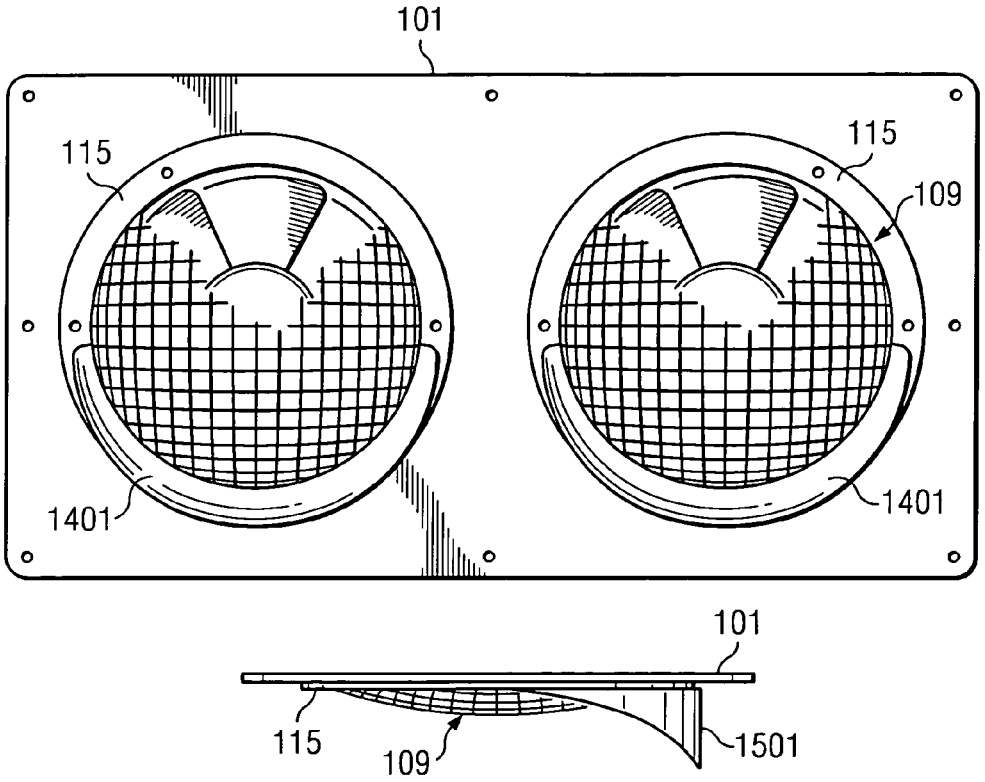
FIG. 23 illustrates a top and side view rain guard features of the aeration apparatus of the present invention.

FIG. 23 illustrates a top 1401 and side view 1501 rain guard features of the aeration apparatus of the present invention.

Figure 24:
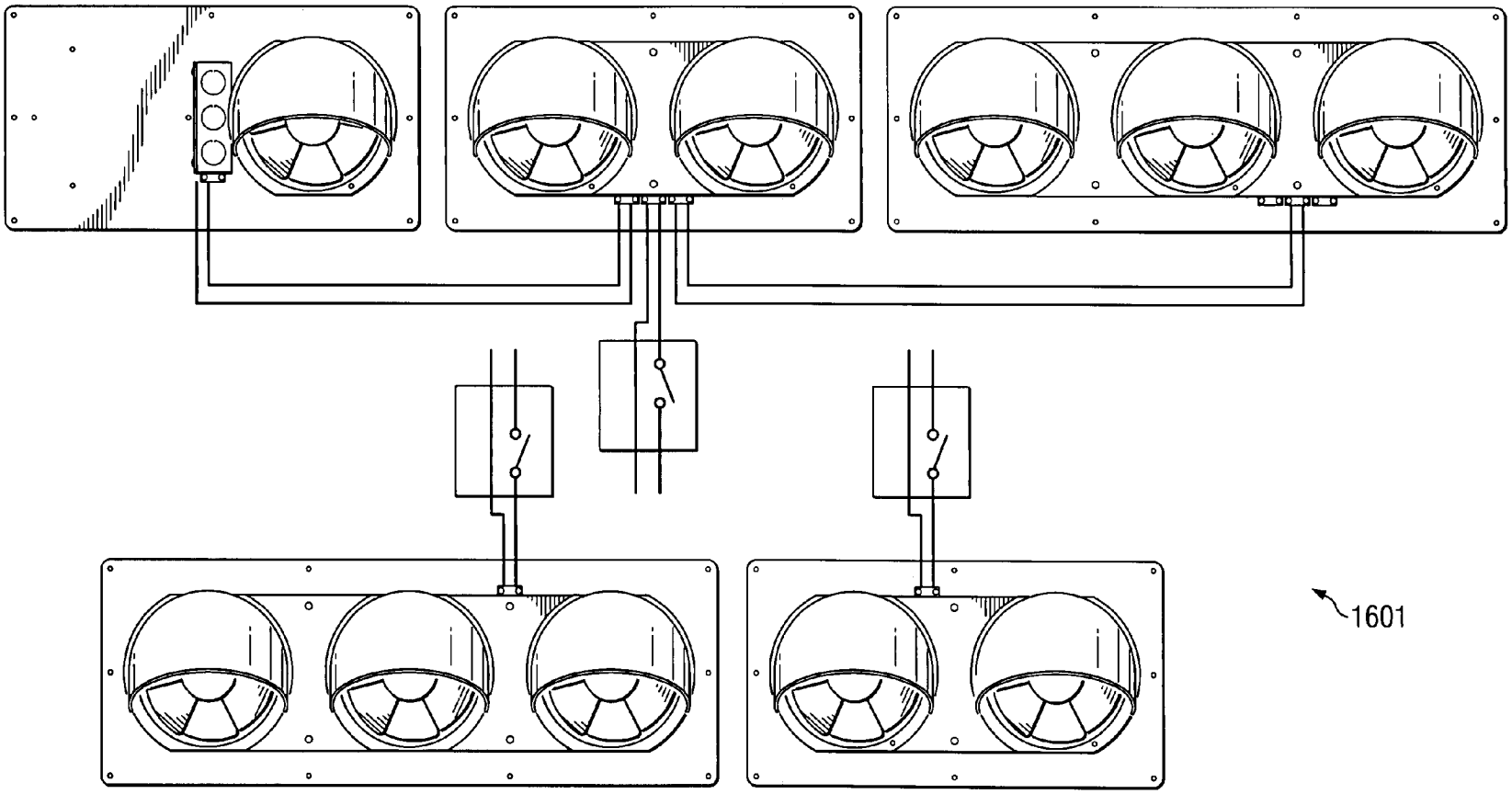
FIG. 24 illustrates a first circuit diagram of the aeration apparatus of the present invention.

FIG. 24 illustrates a first circuit diagram 1601 for wiring the aeration devices together.

Figure 25:
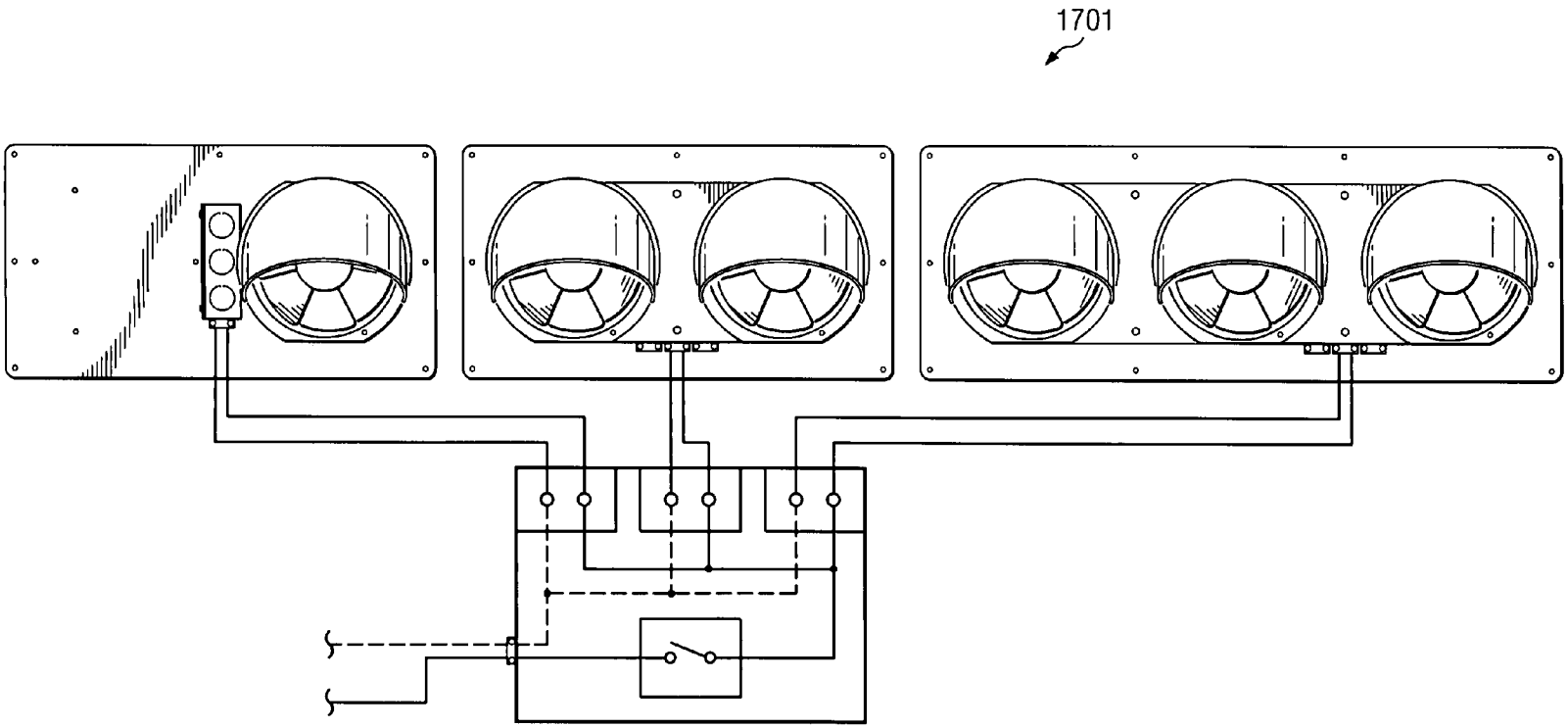
FIG. 25 illustrates a second circuit diagram of the aeration apparatus of the present invention.

FIG. 25 illustrates a second circuit diagram 1701 for wiring the aeration devices together.

Figure 26:
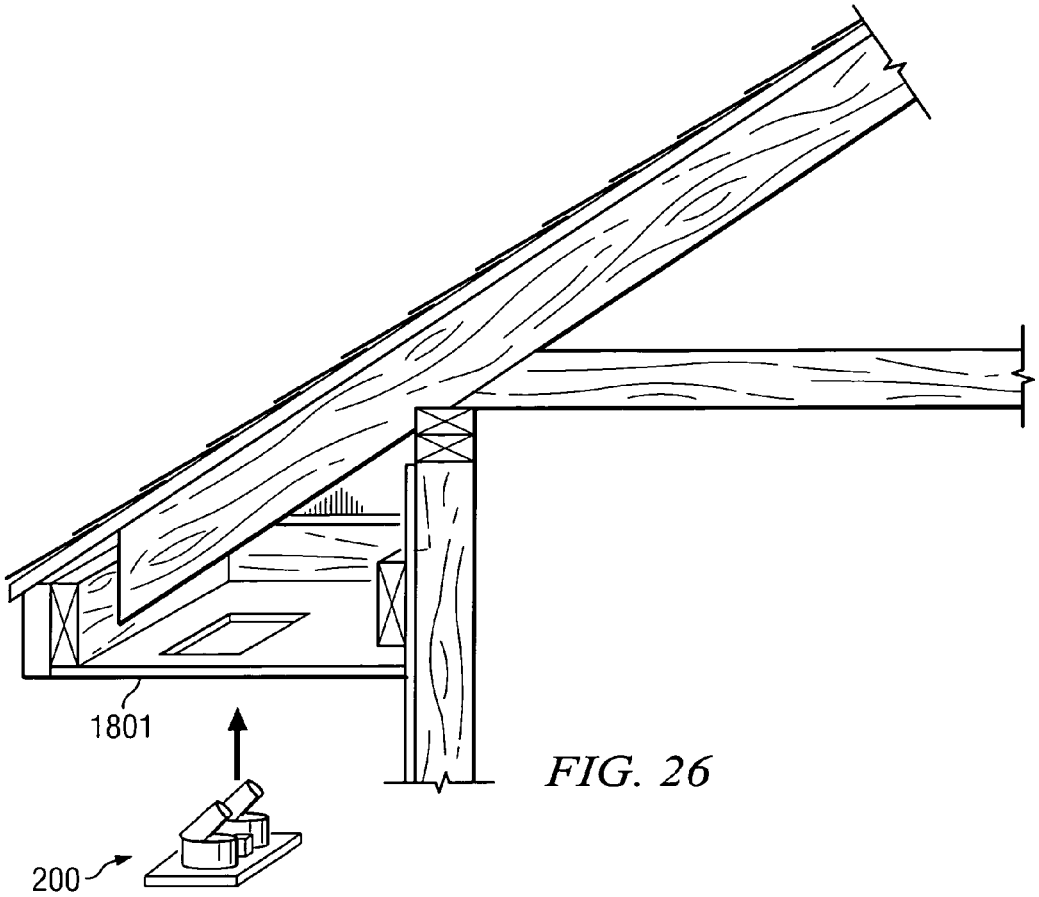
FIG. 26 illustrates the aeration apparatus being positioned in a first position.

FIG. 26 illustrates the aeration device 200 being mounted in the soffit 1801 in the underside of the overhang of the roof of a building which may be a house, a commercial building, a factory some other type of building.

Figure 27:
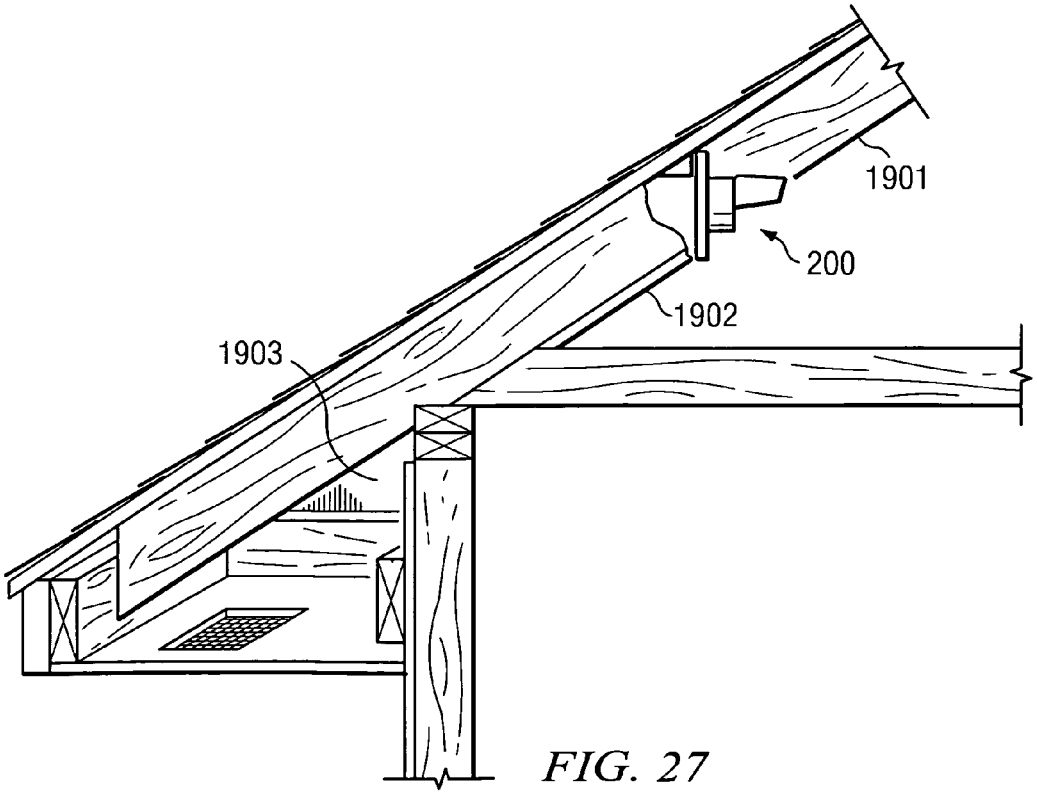
FIG. 27 illustrates the aeration apparatus being positioned in a second position.

FIG. 27 illustrates the aeration device 200 being mounted between the roof joists 1901 of the building which may be a house, a commercial building, a factory or some other type of building, with an air duct created by fastening sheathing 1902 to the joists 1901 & soffit 1903.

Although the descriptions above contain many specifications, these should not be construed as limiting the scope of the invention but as merely providing illustration of some of the embodiments of this invention. For example, an aeration device may be equipped with a two fan motors, one fan motor or multiple fan motors or other fan powered devices; an aeration device may be powered by standard household or industrial electrical current, solar energy or any other alternative energy types or developing energy sources. The aeration apparatus may also be solar powered itself using a solar panels, cells or modules that incorporate the use of mono or poly crystalline or amorphous or other developing solar energy generated materials; the aeration apparatus may also work in concert with other solar powered apparatuses; an aeration device may use different types of motors and electrical configurations which may include high or low voltage AC 115/220-240V or DC 5/12/24/48V power requirements; an aeration device may employ different fan types which might include but not limited to axial fans, cross flow fans, forward blowers, forward curved centrifugal fan, and backward curved centrifugal fans, et.; an aeration device may have a range of different fan air movement performances which may include a number of evolving cubic feet per minute performances and air flow rates; an aeration device may employ using a variety of guards and screens to control bug, animals, dust, fire embers from entering into the unit or attic access. The screen may be different sizes of thin wire mesh, rolled wire form, aluminum/stainless corrugated mesh material or made from any other type of material wood, metal, plastic, or other composite material; an aeration device may be controlled by a thermostats or and/or humidistat's or any other types of electrical operating controls that are electronic or electro mechanical or other.

What is claimed is:

1. An aeration device to be mounted to an aperture of a soffit comprising:

a mounting plate configured for sealable joinder to said aperture of the soffit, said mounting plate having an upper and lower surface, a fan assembly comprising a fan motor and fan blades, said fan assembly having an inflow side and an outflow side, said fan assembly joined proximate said upper surface of said mounting plate, said fan assembly is pivotably mounted with respect to said mounting plate;

a fluid deflector including a truncated dome, said fluid detector fixed to said outflow side of said fan assembly to deflect air from underneath the soffit into an attic space, a portion of said fluid deflector spaced apart from said fan assembly to deflect fan outflow, said fluid deflector being pivotably mounted with respect to said fan assembly.

2. The device of claim 1 wherein said fan assembly comprises an axial fan.

3. The device of claim 1 wherein said fan assembly comprises a crossflow fan.

4. The device of claim 1 further a second fan assembly joined proximate said upper surface of said mounting plate and spaced apart from said first fan assembly.

5. The device of claim 1 for use with adjacent roof joists, further comprising a substantially planar barrier, wherein said barrier is joined to adjacent roof joists, presenting a fluid communication channel from said fan assembly through a roof vent.

6. The device of claim 1 further comprising a control connection in communication with said fan assembly, operable to activate the fan assembly.

* * * * *